United States Patent [19]

Saunders

[11] 4,279,043

[45] Jul. 21, 1981

[54] TRANSFER STAND

[76] Inventor: Bobbie L. Saunders, 5611 W. Circle Z, Tucson, Ariz. 85713

[21] Appl. No.: 84,782

[22] Filed: Oct. 15, 1979

[51] Int. Cl.[3] ..... A61G 1/02

[52] U.S. Cl. ..... 5/81 R; 5/86; 5/503; 5/507; 280/87.04 R

[58] Field of Search ..... 5/81 R, 86, 503, 507; 280/87.04 R

[56] References Cited

U.S. PATENT DOCUMENTS

| | | | |
|---|---|---|---|
| 2,757,388 | 8/1956 | Chisholm | 5/507 |
| 2,792,052 | 5/1957 | Johannesen | 5/86 |
| 2,975,435 | 3/1961 | Forrest | 5/86 |
| 3,272,530 | 9/1966 | Klassen | 5/86 |
| 3,911,509 | 10/1975 | Fleckenstein | 5/86 |
| 3,940,808 | 3/1976 | Petrini | 5/86 |
| 4,065,179 | 12/1977 | Takasaki | 5/86 |

*Primary Examiner*—Casmir A. Nunberg

*Attorney, Agent, or Firm*—Cahill, Sutton and Thomas

[57] ABSTRACT

A rotatable transfer stand includes a base supported by a plurality of castors, a platform rotatably supported by means of bearings on the base and a support structure rigidly attached to the platform and partially surrounding a central standing area on the upper surface of the platform. The support structure includes a horizontal gripping element which can be grasped by a patient, allowing him to pull himself up and securely support himself safely in a standing position with his feet placed in the central standing area.

5 Claims, 9 Drawing Figures

TRANSFER STAND

BACKGROUND OF THE INVENTION

1. Field of the Invention

The invention relates to transfer stands for moving a person able to safely stand with the aid of a support but unable to safely walk.

2. Description of the Prior Art

In the past there have been portable transfer stands used for aiding an attendant or nurse in moving a patient or person able to safely stand with the aid of a support but unable to safely walk. Such devices typically include a platform on which the patient stands. The platform is rotatably mounted on a base. A support structure for gripping by the patient as he supports himself in a standing position is attached to the platform. However, some of the prior transfer stands have been bulky and inconvenient to use. Others have not provided adequate structural support around the patient. Known prior devices have been capable only of moving the patient by rotating him in a standing position.

U.S. Pat. No. 3,911,509 discloses a device with a centrally mounted upright extending from a rotatable platform. A pair of grips are provided on a handlebar assembly attached to the upper end of the post. In use, an attendant must step on one side of the platform to balance it as the patient pulls himself to a standing position on the opposite side of the platform by means of the grips. The device has spring loaded castors which allow the device to be rolled along the floor if no one is standing on the platform. However, the castors automatically lock by engaging friction brake pads when someone steps on the platform. The device of U.S. Pat. No. 3,911,509 is unduly complex and expensive. The necessity that an attendant stand on one side of the device to balance it while the patient pulls himself into the standing position on the other side of the platform by means of the grips on the ends of the handlebar prevents the attendant from assisting the patient. Further, the transfer stand disclosed in U.S. Pat. No. 3,911,509 does not give the appearance of being a safe device. Its appearance tends to discourage certain patients, especially elderly, overweight patients, from using the device.

Accordingly, it is an object of the invention to provide a patient transfer stand which gives an appearance of safety and inspires a sense of security in a patient who is to use the transfer stand.

Another object of the invention is to provide a patient's transfer stand which is simple but rugged in construction and low in cost and complexity.

Another object of the invention is to provide a safe, economical transfer stand capable of both moving a patient supported in a standing position on the transfer stand by laterally moving the transfer stand across a floor and moving the patient by rotating the transfer stand.

U.S. Pat. No. 2,963,713 discloses an invalid transfer apparatus including a base which rests flat upon a floor surface and a platform rotatably mounted on the base. Three posts rigidly connected to the platform extend vertically upward, the three posts being connected by horizontal U-shaped cross members. A pair of wheels is attached to one of the posts, enabling the device to be tilted so that the wheels roll on the floor surface, raising the platform and allowing the device to be moved. The device disclosed in U.S. Pat. No. 2,963,713 is bulky and awkward to use, and is incapable of lateral movement when a patient is supported on the platform.

U.S. Pat. No. 2,757,388 discloses a transfer stand having a platform rotatably mounted upon a base and a support structure including two verticle posts rigidly mounted along the forward edge of the platform. A gripping structure extends rearward from the tops of the two verticle posts and curves upward and forward to produce a U-shaped horizontal cross bar which can be gripped by the patient. The rearward extending portions provide a slight degree of enclosure of the standing region, but do not extend far eoungh to provide a strong sense of security in a feeble or disabled person. An attendant or nurse rotates the device by pressing with her foot on a ratchet-like treadle attached to a stationery base on which the platform is rotatably mounted. The treadle engages teeth along the circumference of the platform in a ratchet-like fashion. Turning of the transfer stand is an awkward and occasionally abrupt operation, especially when the pressure on the treadle by the attendant's foot is inadvertently, slightly released during rotation, so that the treadle engages a tooth of the transfer stand. This produces an abrupt halt to rotation of the stand before the patient has been rotated to the desired position. The device is incapable of permitting movement of the patient across the floor while the patient is in a standing position.

Accordingly, it is another object of the invention to provide an economical, rugged patient transfer stand which substantially encloses a central standing area so as to inpart to a patient a sense of security and which is capable of allowing movement of a patient across a floor in addition to allowing rotation of the patient and which overcomes the various shortcomings of the prior art.

SUMMARY OF THE INVENTION

Briefly described, and in accordance with one embodiment thereof, the invention provides a transfer stand for moving a patient capable of pulling himself to his feet and standing with aid of support but incapable of safely walking, the transfer stand including a standing platform rotatably disposed upon a base. The base is mounted on a plurality of lockable castors which permit movement of the transfer stand and a patient thereon across a floor surface. The lockable castors include brake mechanisms which prevent undesired rolling of the castors. A support structure having a pair of opposed horizontal gripping elements substantially surrounds three sides of the patient standing region, giving the patient a sense of stability and security. A brake element is deployable to frictionally engage the platform with the base, preventing rotation of the patient when the patient pulls himself into a standing position on the platform or lowers himself to a seated position on an adjacent piece of furniture. In one embodiment of the invention, removable, adjustable crutch supports are attached to the support structure to enable the person standing on the platform to be supported by resting his armpits on the crutch supports. In another embodiment of the invention, a hingeable seat is provided which can be raised to leave the standing region free and can be lowered to allow the transfer stand to be used as a rollable chair.

DESCRIPTION OF THE INVENTION

Figure 1:
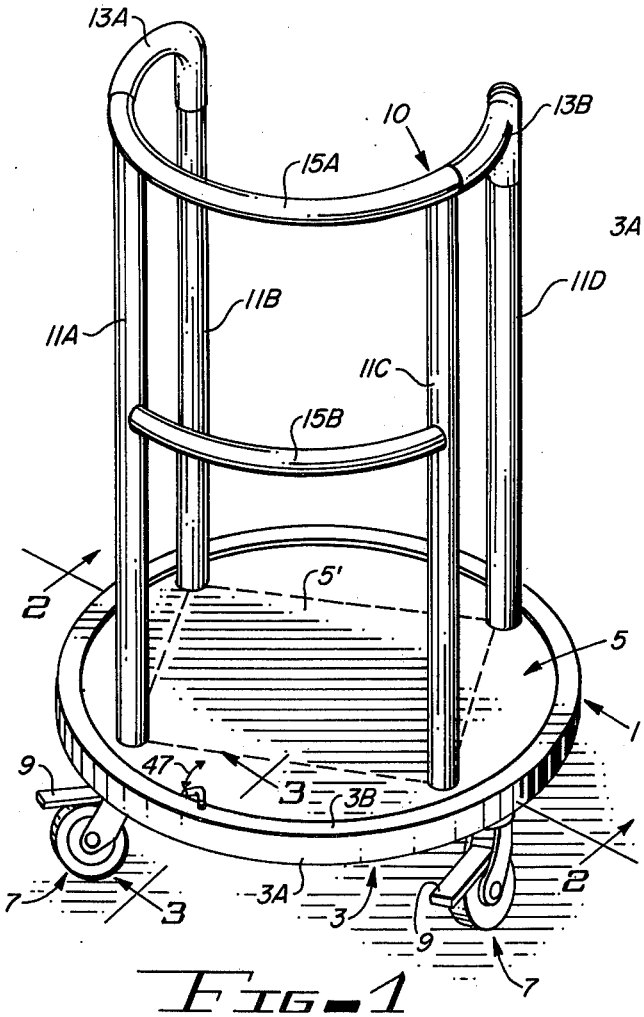
FIG. 1 is a perspective view of a transfer stand in accordance with the present invention.
Figure 3:
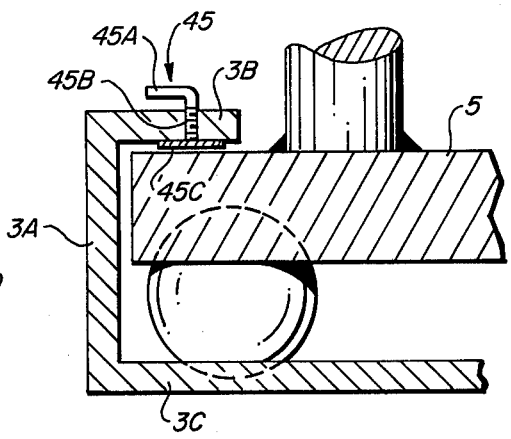
FIG. 3 is a partial sectional view useful in describing the bearing and brake assemblies of the device shown in FIG. 1.
Figure 4:
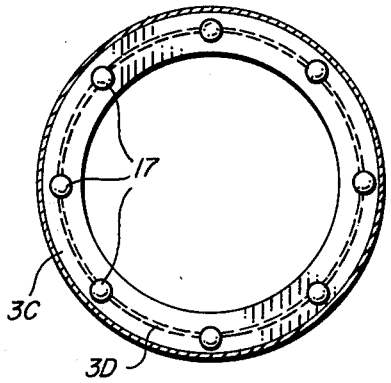
FIG. 4 is a section view taken along section lines 4—4 of FIG. 2.

Referring now to the drawings, particularly FIGS. 1-4, transfer stand 1 includes a circular base 3 having a vertical side wall 3A, and top flange 3B extending inwardly of side wall 3A, and a lower flange 3C. A plurality of lockable castors 3 are attached to lower flange 3C at four points which are equally circumferentially spaced around flange 3C. Castors 9 are locking castors, which can be locked or unlocked by means of levers 9. (Of course, other types of lockable castors which are readily available can be used in place of those shown in the drawings.) An attendant can easily lock each castor by depressing lever 9 with his foot and can unlock that castor by lifting lever 9 with his toe.

Figure 2:
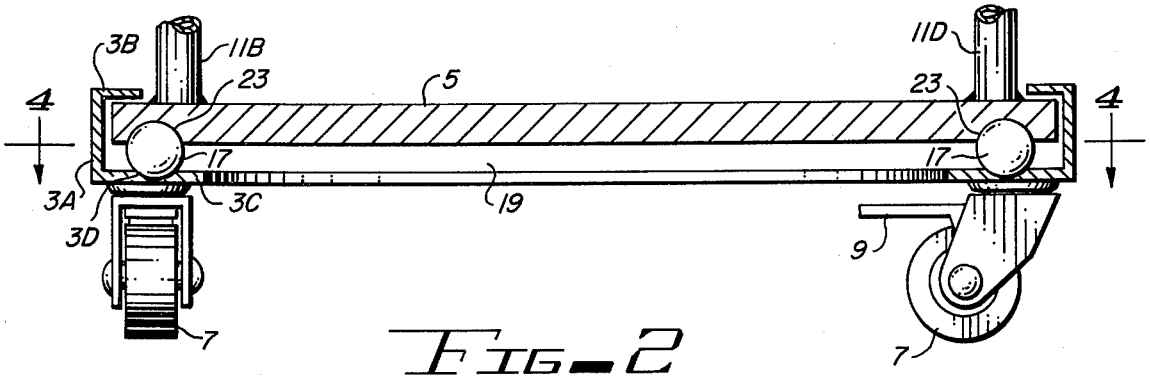
FIG. 2 is a section view taken along lines 2—2 of FIG. 1.

A circular platform 5 having a flat surface is rotatably supported on the upper surace of circular flange 3C by means of a plurality of bearing balls 17, as shown in FIG. 2. Bearing balls 17 are retained in fixed relationship with platform 5 by means of a plurality of hemispherical recesses 23 disposed in the lower surface of platform 5. Thus, as platform 5 rotates relative to platform 3, balls 17 roll along circular track 3D, which is disposed in the upper surface of annular flange 3C.

Upper flange or lip 3B extends over the upper surface of platform 5, and retains platform 5 in the illustrated relationship with base 3. The spacing between flange 3B and platform 5 is sufficiently small that if transfer stand 5 is lifted by means of the support structure (subsequently described), base 3 will also be lifted without any of bearing balls 17 becoming dislodged from their respective hemispherical recesses 23.

Support structure 10 includes four posts 11A, 11B, 11C and 11D which are rigidly attached to the upper surface of platform 5. The four points at which posts 11A, 11B, 11C and 11D are attached to the upper surface of platform 5 lie at the corners of a generally rectangular standing area 5', outlined by dotted lines in FIG. 1.

A lower front horizontal cross bar 15B is rigidly attached to posts 11A and 11C at points located roughly midway between the upper and lower ends of posts 11A and 11C, respectively. Upper front cross bar 15A is rigidly connected between the upper ends of vertical posts 11A and 11C, respectively. Front cross bars 15A and 15B are generally curved, having a radius of curvature somewhat less than the radius of curvature of platform 5.

A first gripping element 13A is rigidly attached to the upper end of vertical post 11B and is also rigidly attached to the upper end of vertical post 11A. Similarly, gripping member 13B is rigidly attached to the upper end of vertical post 11D and the upper end of vertical post 11C.

A brake mechanism 45 includes a brake pad 45C attached to the end of a threaded screw shaft 45B. Handle 45A is attached at right angles to shaft 45B. The threads of shaft 45B mate with corresponding threads in a hole through upper flange 3B. Thus, when handle 45A is turned in the directions indicated by arrow 45 (FIG. 1), brake pad 45C is either lowered to frictionally engage the upper surface of platform 5 (thereby preventing platform 5 from rotating relative to base 3) or raised into a shallow recess in the lower surface of flange 3B.

Support structure 10 can be made of tubular chrome plated steel. Gripping members 13A and 13B can have a partially knurled surface or a rubber sleeve to enhance gripping by the hands of a patient utilizing transfer stand 1. Platform 5 is preferably formed of steel, standing area 5' having a knurled or roughened slip-proof surface. If desired, a rubber pad can be placed on the upper surface of platform 5 in the general location of standing area 5'.

In use, an attendant can easily roll transfer stand 1 to a chair or bed on which a patient is seated. Transfer stand 1 can be positioned so that its entrance, between posts 11B and 11D, is immediately in front of the patient. Transfer stand 1 can be pushed sufficiently close to the patient that the patient's one or both of the patient's feet can be placed on platform 5. The attendant can then lock the castors of at least two of wheels 7 by depressing the corresponding brake levers 9. The attendant also can engage brake mechanism 45 by turning lever 45A to prevent rotation of platform 5. The attendant then can help the patient rise from a sitting position on the chair or bed to a standing position in the region above surface area 5.

The support structure 10 then surrounds both sides and the front of the patient, giving him a strong feeling of security and stability.

If it only is desired to transfer the patient from the above mentioned sitting position on the edge of a chair or bed to a wheelchair, which can be positioned immediately adjacent transfer stand 1, the attendant need only disengage brake mechanism 45 and gradually apply a turning force to support structure 10, thereby gradually rotating the patient until his posterier is immediately in front of the wheelchair. The attendant then can re-engage brake mechanism 45, and, if desired, assist the patient in lowering himself into the wheelchair.

However, if it is desirable to move the patient a considerable distance from the sitting position at the edge of the bed, for example, into a bathroom and in front of a toilet, the attendant can leave brake mechanism 45 engaged after the patient initially attains a standing position in the region above surface area 5'. The attendant can then disengage the locked castors by using his toe to lift brake levers 9 of the locked castors. The attendant may then roll transfer stand 1 with the patient standing thereon into the desired location in front of the toilet, and then can lock at least two castors. The attendant would then disengage brake 45, rotate support structure 10 to orient the patient in front of the toilet, and relock brake mechanism 45. If desired, the attendant then could aid the patient as necessary.

Figure 5:
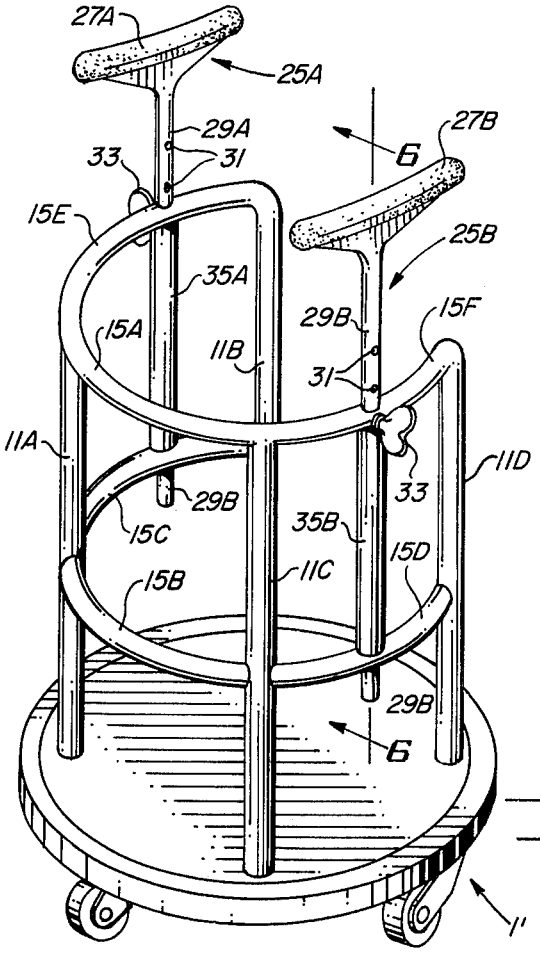
FIG. 5 is a perspective view of a modification of the embodiment of the invention shown in FIG. 1.

An alternate embodiment of the invention is shown in FIG. 5, wherein a pair of removable, vertically adjustable crutch members 25A and 25B are slideably disposed in a pair of tubular cylinders 35A and 35B. Cylinder 35A is rigidly attached between side cross bars 15E and 15C, each of which have holes therein for slideably accommodating shaft 29A of crutch member 25A. A spring loaded pin 35 has a pin shaft which extends through a side opening in side cross bar 15E. A plurality of pin accommodating holes 31 are disposed in spaced relationship along shaft 29A, permitting the user to adjust the height of pad 27A of crutch member 25A. The structure and adjustment of height of crutch member 25B are similar. This embodiment of the invention provides additional support for a patient over the support shown by the embodiment of FIG. 1. Utilization of transfer stand 1' of FIG. 5 is entirely similar to that described above with reference to FIG. 1, and will not be set forth in detail.

Figure 6:
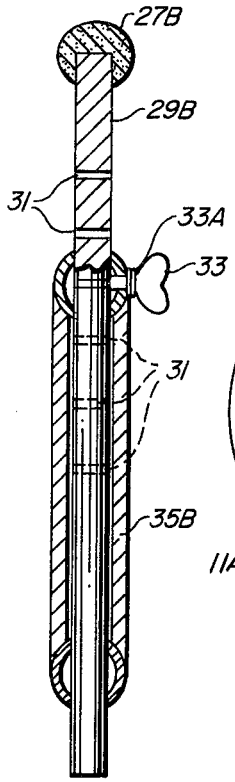
FIG. 6 is a sectional view taken along section lines 6—6 of FIG. 5.

FIG. 6 shows a sectional view along section lines 6—6 of FIG. 5.

Figure 9:
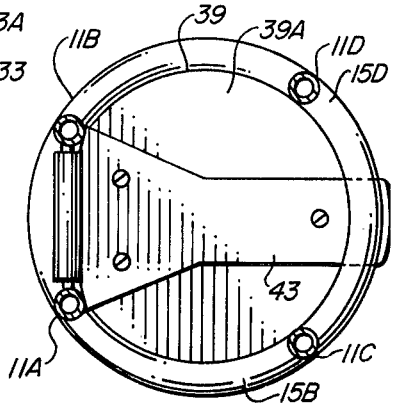
FIG. 9 is a section view taken along section lines 9—9 of FIG. 8.
Figure 8:
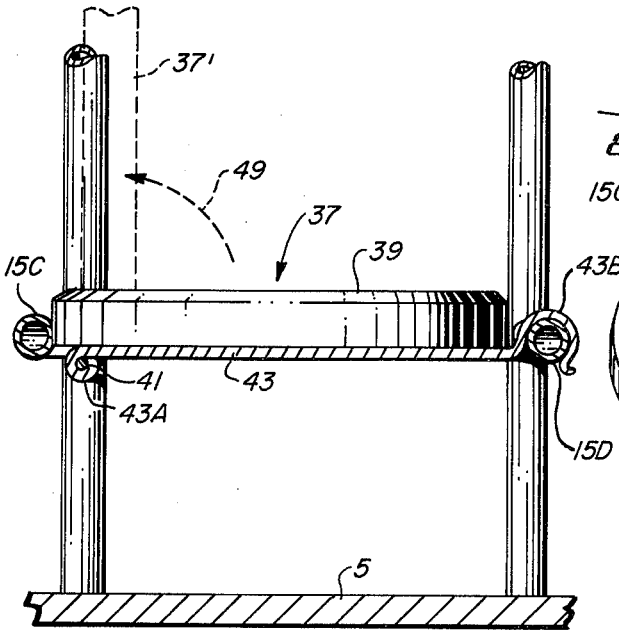
FIG. 8 is a partial section view taken along section lines 8—8 of FIG. 7.
Figure 7:
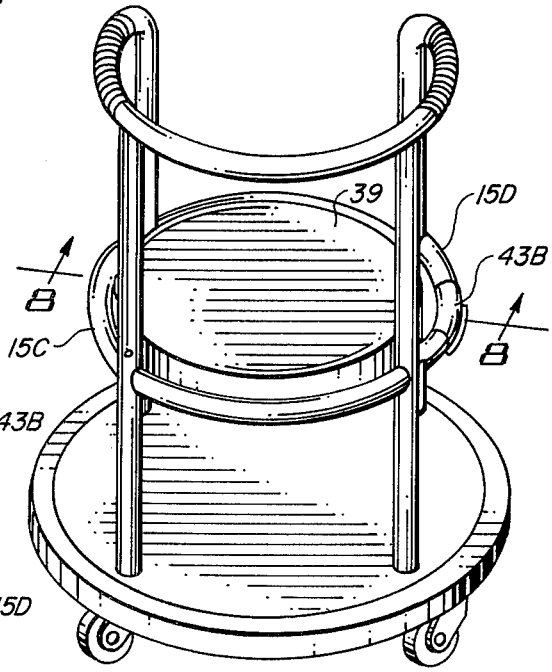
FIG. 7 is a perspective view of another embodiment of the invention.

Another embodiment of the invention is shown in FIGS. 7–9, wherein a hingeable seat 37 can be raised to or lowered from the position indicated by dotted lines 37' in FIG. 8, as indicated by arrow 49. Seat 37 includes a circular cushion 39 mounted on a circular rigid cushion support 39A (FIG. 9). Cushion support 39A is supported by a metal support plate 43. Support plate 43 is hingeably connected to a pair of hinge pins 41, the ends of which are supported by vertical posts 11A and 11B, respectively.

The left-hand end of support plate 43, as shown in FIGS. 8 and 9, forms a curved section 43A which surrounds hinge pin 41. The right-hand end of base plate 43 is contoured to form a clip end section 43B, which clips onto side cross member 15D.

The folding seat arrangement 37 of FIGS. 7–9 adds additional flexibility to the embodiment of the invention shown in FIG. 1, whereby the device can be utilized as a chair for wheeling patients about.

Thus, the disclosed embodiments of the invention provide means of enabling an attendant to easily move a patient from place to place. The disclosed transfer stand is suitable for safe, convenient use in private homes as well as in medical facilities. The disclosed transfer stand provides patients with a sense of safety and security, and consequently they usually do not resist being transported by the device.

While the invention has been described with reference to several embodiments thereof, those skilled in the art will be able to make various modifications to the structure of the disclosed embodiments of the invention without departing from the true spirit and scope of the invention.

I claim:

1. A device for rotational and lateral movement of a person able to stand but not to walk, said device comprising in combination:

a. a base having an upper surface and a lower surface;

b. four castors attached to the bottom surface of said base to effect rolling of said device across a floor, wherein said castors include brake mechanisms;

c. a platform rotatably disposed above said base;

d. bearing means disposed between said base and said platform for rotatably supporting said platform on said base, said platform having an upper surface;

e. a support structure grippable by the person for supporting the person in a central standing position on the upper surface of said platform, said support structure being rigidly attached to the upper surface of said base, said support structure including i. first, second, third and fourth vertical post elements extending from first, second, third, and fourth points on the upper surface of said platform, said first, second, third, and fourth points lying on the four corners of a roughly rectangular standing area substantially centrally disposed on the upper surface of said platform;

ii. first and second horizontal gripping elements, said first horizontal gripping element extending between and being rigidly connected to the upper ends of said first and second vertical post elements, said second vertical gripping element extending between and being rigidly connected to the upper end of said third and fourth vertical post elements, the distance between said third and fourth vertical post eleements being sufficiently large that said first and second horizontal gripping elements each extend substantially forward and rearward of a person standing substantially centrally in said substantially rectangular standing gear;

iii. a first front cross bar element extending between and rigidly connected to the upper ends of said second and third post elements; and f. a brake mechanism activatable to frictionally engage said base with said platform to prevent rotation therebetween.

2. The device of claim 1 wherein said base and said platform are round.

3. The device of claim 1 wherein said first and second horizontal gripping elements include by first and second horizontal cross members, respectively, said device including first and second crutch supports adjustably attached to said first and second horizontal cross members, respectively.

4. The device of claim 1 including seat means hingeably connected to two of said post elements, said seat means raisable to a position outside of a standing region above said standing area and lowerable to a substantially horizontal position over said standing area between the upper and lower ends of said posts.

5. The device of claim 1 wherein said bearing means includes a plurality of bearing balls disposed between said platform and said base.

* * * * *